US010894441B2

(12) United States Patent
Treacy

(10) Patent No.: US 10,894,441 B2
(45) Date of Patent: Jan. 19, 2021

(54) PAINTBRUSH HOLSTER

(71) Applicant: Ryan Treacy, Winter Haven, FL (US)

(72) Inventor: Ryan Treacy, Winter Haven, FL (US)

( * ) Notice: Subject to any disclaimer, the term of this patent is extended or adjusted under 35 U.S.C. 154(b) by 0 days.

(21) Appl. No.: 15/596,881

(22) Filed: May 16, 2017

(65) Prior Publication Data

US 2018/0222249 A1 Aug. 9, 2018

Related U.S. Application Data

(60) Provisional application No. 62/454,815, filed on Feb. 5, 2017.

(51) Int. Cl.
*B65D 75/14* (2006.01)
*B44D 3/12* (2006.01)

(52) U.S. Cl.
CPC ..... *B44D 3/123* (2013.01); *B44D 3/125* (2013.01)

(58) Field of Classification Search
CPC ..... B44D 3/123; B44D 3/125; A46B 17/04
USPC ..... 206/15.2, 15.3, 361, 362.2, 362.3, 818; 220/495.01, 495.02, 495.06, 230
See application file for complete search history.

(56) References Cited

U.S. PATENT DOCUMENTS 3,905,476 A * 9/1975 Foreman ..... B44D 3/121 206/361
4,802,576 A * 2/1989 Kern ..... B44D 3/126 15/257.06
5,244,090 A * 9/1993 Keith ..... A46B 17/04 15/142
5,540,363 A * 7/1996 Wilson ..... B44D 3/125 206/15.3
5,645,164 A * 7/1997 Hocking ..... B44D 3/126 206/15.3
5,924,566 A * 7/1999 Gibbs ..... B65D 43/163 206/15.3
5,941,379 A * 8/1999 Barardo ..... A47K 11/10 15/104.94
6,050,408 A * 4/2000 Testa ..... A46B 17/04 206/15.2
6,196,410 B1 * 3/2001 Hocking ..... B44D 3/126 206/209
D511,412 S * 11/2005 Madrid ..... D3/228
8,074,796 B1 * 12/2011 Andrews ..... A46B 17/04 206/15.3
8,091,701 B1 * 1/2012 DePietro ..... B44D 3/123 206/15.3
8,882,605 B1 * 11/2014 Lee ..... A63B 47/04 473/131
2005/0247030 A1 * 11/2005 Phillips ..... B44D 3/125 53/397
2006/0113310 A1 * 6/2006 Hawkins ..... B44D 3/123 220/736
2013/0112580 A1 * 5/2013 Johnson ..... B44D 3/125 206/361
2013/0233735 A1 * 9/2013 Hurley ..... B44D 3/125 206/209
2013/0299362 A1 * 11/2013 DePaola, Jr. ..... B44D 3/125 206/1.7
2014/0102926 A1 * 4/2014 Bidwell ..... B44D 3/123 206/361

(Continued)

*Primary Examiner* — Luan K Bui
(74) *Attorney, Agent, or Firm* — Cygnet IP Law, P.A.; Stephen W. Aycock, II

(57) ABSTRACT

Paint brush holsters and liners are described.

16 Claims, 5 Drawing Sheets

(56) References Cited

U.S. PATENT DOCUMENTS

2014/0144797 A1* 5/2014 Lareau ..... B44D 3/123
206/361

* cited by examiner

PAINTBRUSH HOLSTER

RELATED APPLICATIONS

This application claims the benefit of U.S. Provisional Application No. 62/454,815, entitled "PAINT BRUSH HOLSTER," and filed on Feb. 5, 2017, which is incorporated herein by reference in its entirety.

TECHNICAL FIELD

Some implementations relate generally to painting equipment, and more particularly, to a holster and optional liner for a paintbrush.

BACKGROUND

Some existing products designed to hold paintbrushes may permit the paintbrush to be placed on a side of a bucket or paint can. Other products include a case that holds a paintbrush so that the paint brush can be placed into a pocket or bag.

A need may exist for a paint brush holster that can hold a paintbrush in such a manner that the paint brush is protected from the elements, and at the same time keeps the paint brush readily accessible for continued painting.

Some implementations were conceived in light of the above mentioned needs, among other things.

SUMMARY

Some implementations can include a paintbrush holster. The paintbrush holder comprising a body having a first side, a second side, a bottom, and a back side having an upper section, a lower section, and a transition between the upper section and the lower section, the transition having an angle extending toward an outside from the upper section to the lower section, the body also having a recessed body area configured to permit a handle of a paintbrush to pass through the recessed body area. The paintbrush holster also comprising a door connected to the body portion via one or more hinges, the door having a recessed door area configured to permit a handle of the paintbrush to pass through the recessed door area.

The body can include one or more body closure magnets attached to a back side of the paintbrush holder adjacent to the recessed body area. The door includes one or more magnets or metal elements attached to an inside of the door adjacent the recessed body area, which corresponds to locations of the door magnets.

Some implementations can include a finger catch extending at an angle from a top area of the door. Some implementations can include a clip attached to a back surface of the paintbrush holster.

Some implementations can include a magnet disposed inside a back surface of the paintbrush. Some implementations can include further comprising a removable liner configured to be inserted into a space of the paintbrush holster defined by a front, back and sides of the body.

DETAILED DESCRIPTION

In general, some implementations can include a paint brush holster that clips to a user's pants or belt and permits the user to carry a paintbrush in the holster. This can help free the user's hand, which can make working on ladders or other environments safer by permitting the user to use the freed hand to grip railings, ladders or other objects for safe movement about a work site. The holster can be configured to protect paintbrushes of various sizes (e.g., from about ½" to 3" or more) and to prevent elements (e.g., dirt, debris, water, wind, sunlight, etc.) from contacting and/or contaminating the wet paint on the bristles of the brush while it is in the holster. Thus, when in the holster, the paintbrush may be kept clean, and the wet paint on the bristles of the paintbrush may be kept moist. It will be appreciated that a paintbrush holster according to the present disclosure could be made to accommodate a specific brush size, for example, 1 inch or 2 inch brushes.

Figure 1:
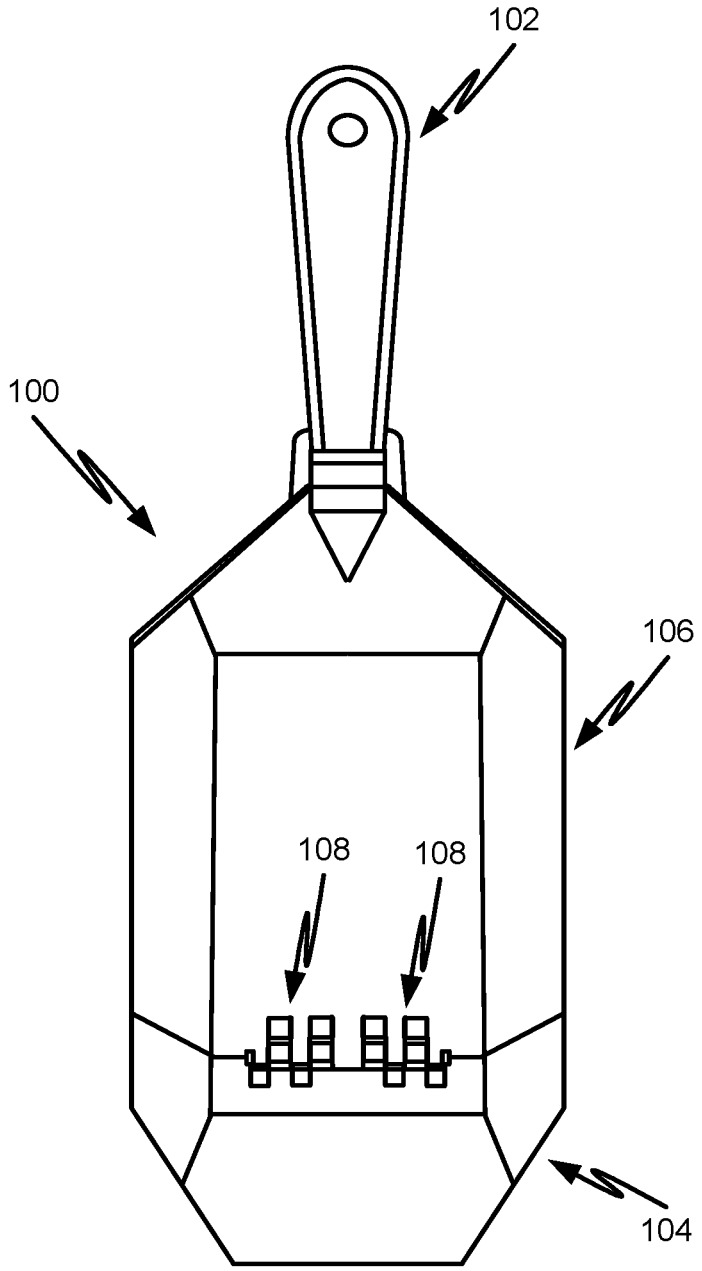
FIG. 1 is a front perspective view of an example paintbrush holster in accordance with some implementations.
Figure 5:
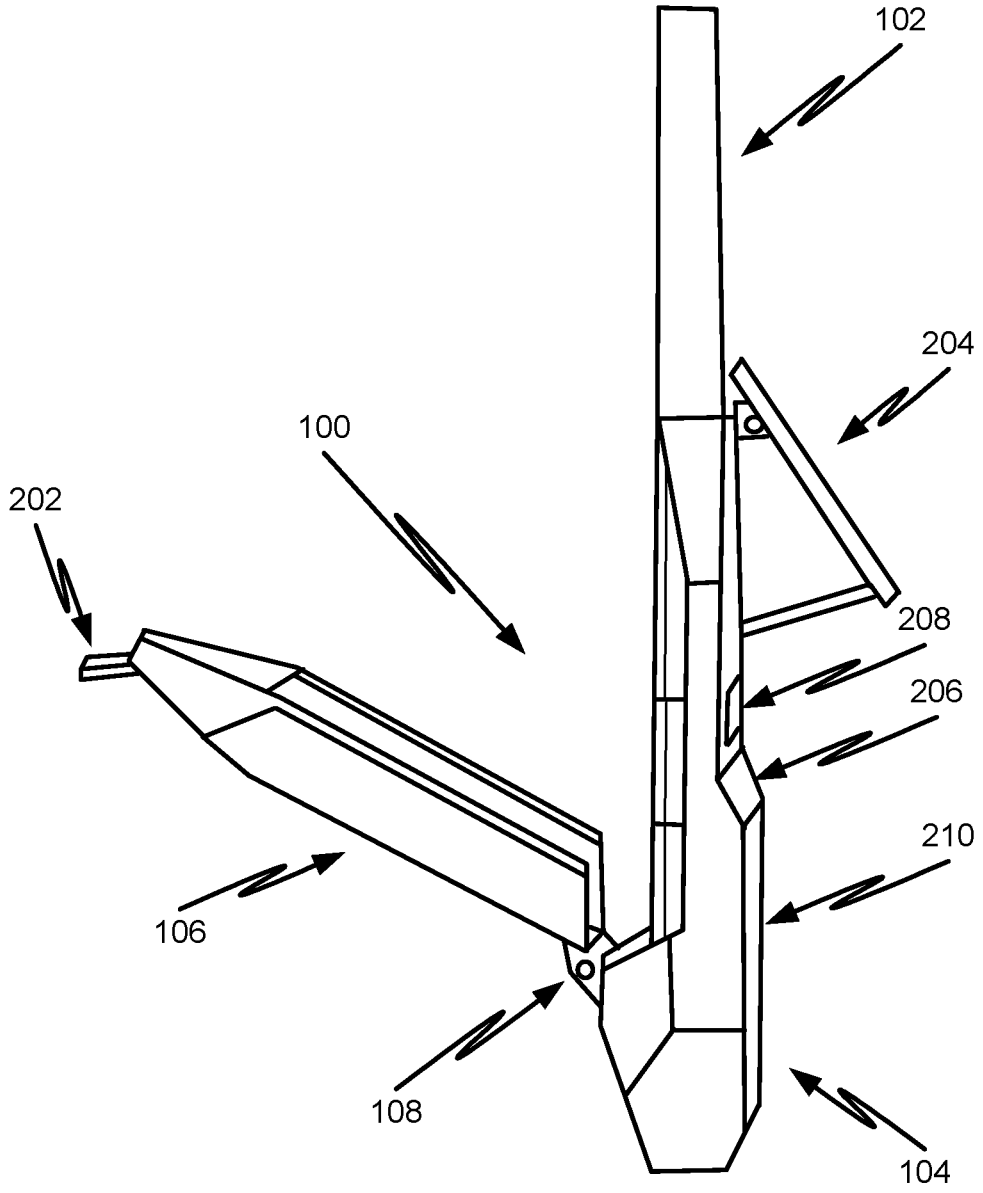
FIG. 5 is a side perspective view of an example paintbrush holster with the door open in accordance with some implementations.

FIG. 1 is a front perspective view of an example paintbrush holster 100 having a paintbrush 102 stored in the holster 100. The holster 100 includes a body portion 104 and a door 106. The door 106 is connected to the body portion 104 via two hinges 108. The door 106 can rotationally transition from a first position (e.g., closed as shown in FIG. 2) to a second position (e.g., open, as shown in FIG. 5).

Figure 2:
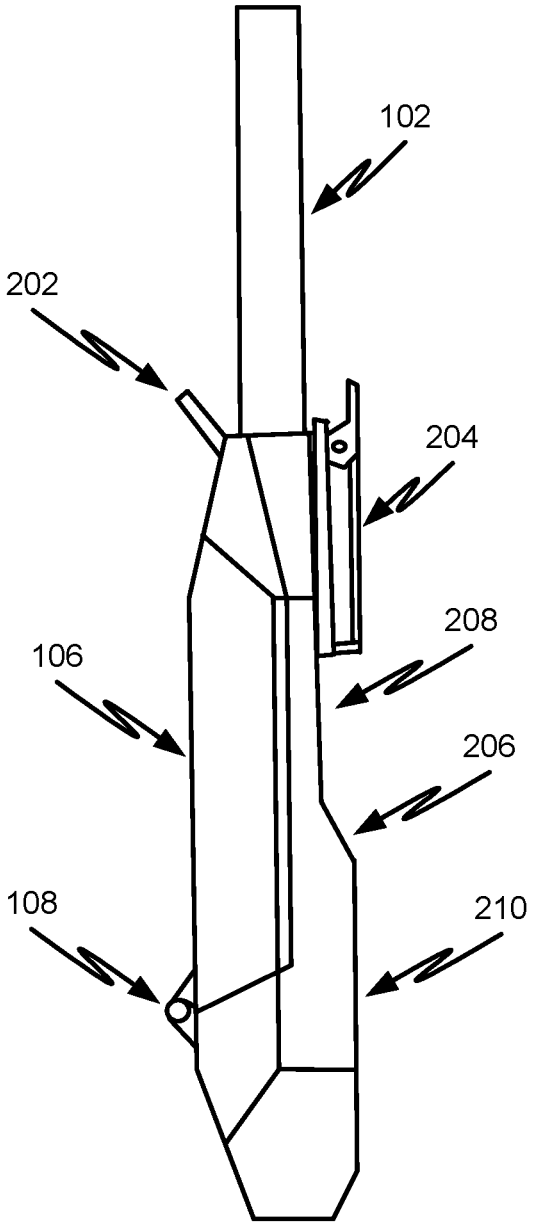
FIG. 2 is a side perspective view of an example paintbrush holster in accordance with some implementations.

FIG. 2 is a side perspective view of an the example paintbrush holster 100 showing, in addition to the elements mentioned above regarding FIG. 1, a finger catch 202 to help a user release and open the door 106. FIG. 2 also shows a clip 204 (e.g., a spring loaded rotating clip) for attaching the paintbrush holster 100 to a belt, pants, shorts, etc. The body portion 104 includes an angled transition region 206 between an upper section 208 and a lower section 210 of the body 104.

Figure 3:
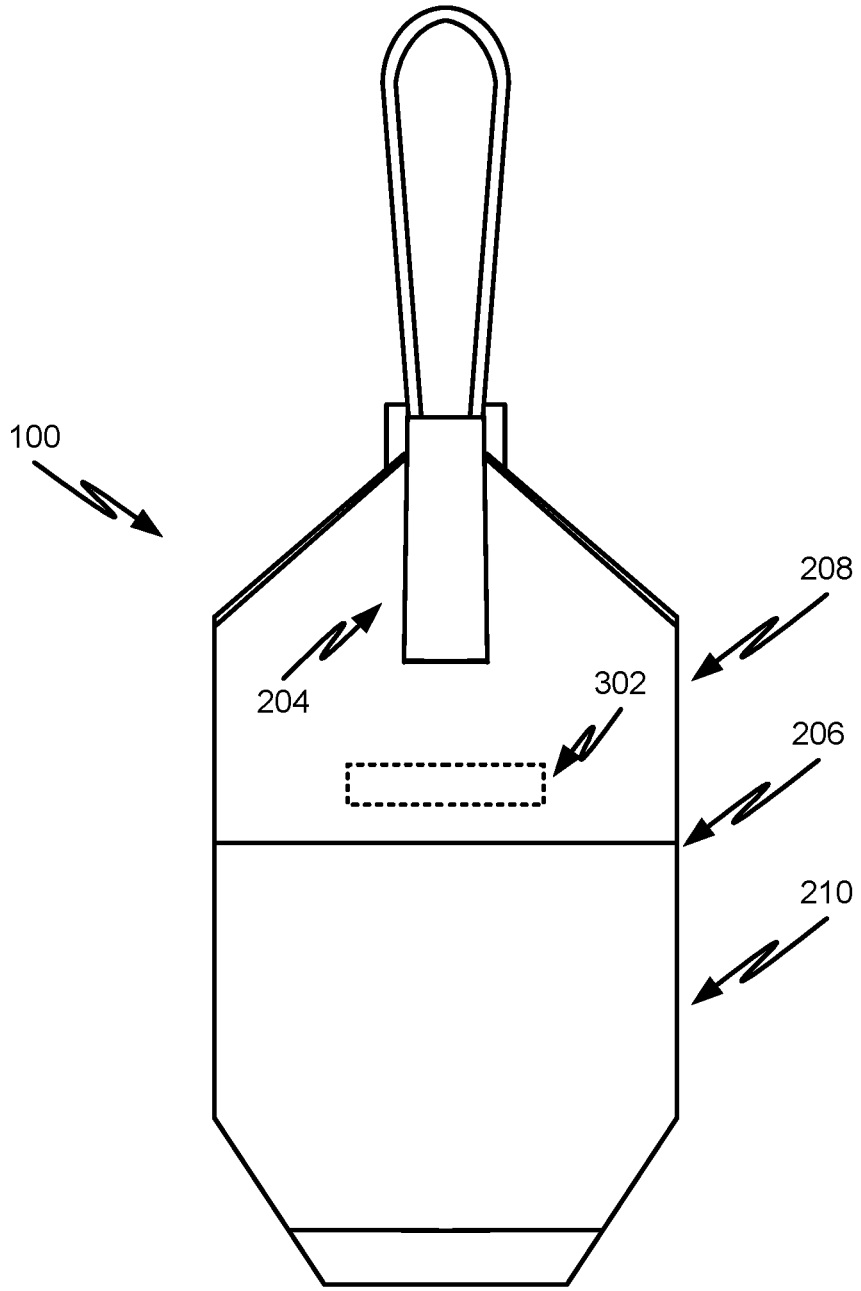
FIG. 3 is a rear perspective view of an example paintbrush holster in accordance with some implementations.

FIG. 3 is a rear perspective view of the paintbrush holster 100 showing some of the elements mentioned above. FIG. 3 shows a paintbrush holder magnet 302 disposed on an inside of the backside of the body 104.

Figure 4:
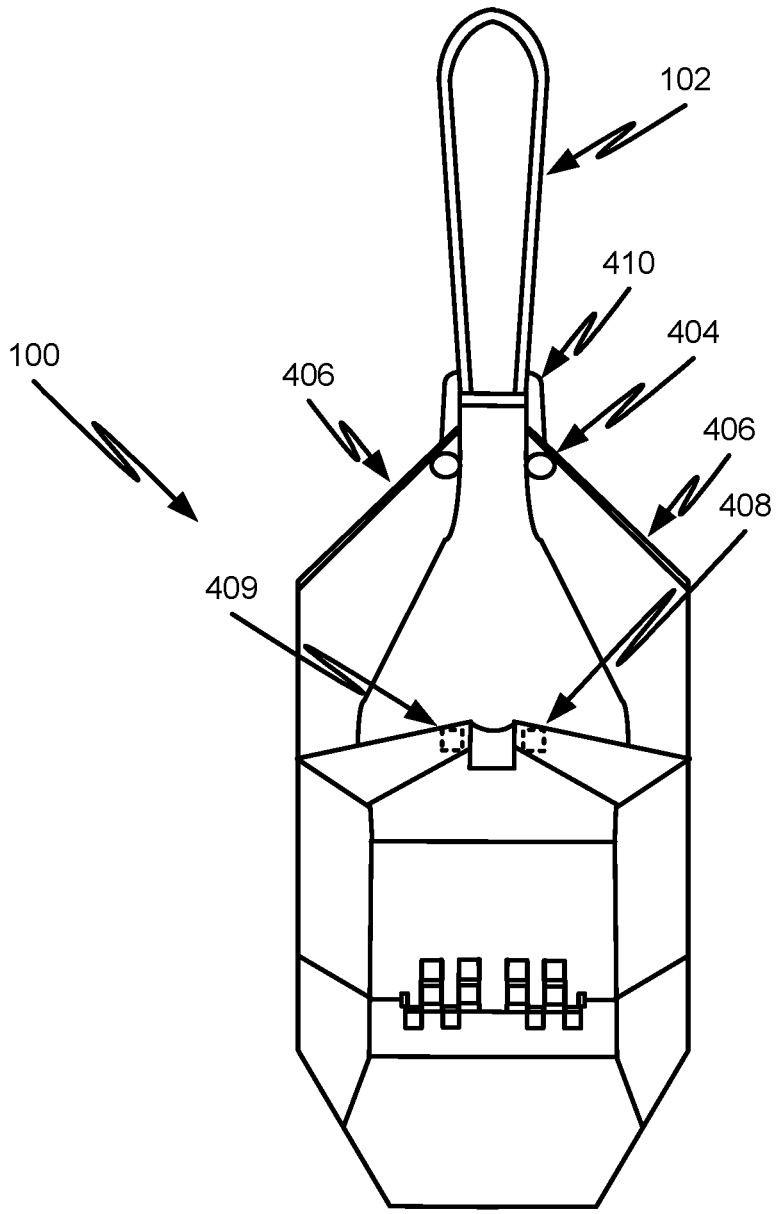
FIG. 4 is a front perspective view of an example paintbrush holster with the door open in accordance with some implementations.

FIG. 4 is a front perspective view of the example paintbrush holster 100 showing one or more magnets (402, 404) mounted on the body 104 adjacent the area where a handle of the paintbrush 102 passes out of the paintbrush holder 100. One or more cooperative corresponding magnets or metal pieces (408, 409) are disposed within the door 106 and are configured to magnetically engage the corresponding one or more magnets (402, 404) when the door 106 is in a closed position (e.g., as shown in FIG. 2) and hold the door in the closed position until enough force is exerted on the door 106 (e.g., via the finger catch 202) to overcome the magnetic force between 402, 404 and 408, 409 respectively.

Some implementations of the holster can include the angled corner/contour profile shown in the figures described above. The angled corners profile can help keep the holster from snagging on clothing or catching on other items such as ladders, paint cans, buckets, etc. The angled edge design can also help improve the strength of the holster to help prevent damage to the holster from bumps or drops. It will be appreciated that the holster could be formed in other shapes such as rectangular, cubic or cube-like, oval, square, octahedron, or a paintbrush contour shape having a size corresponding to the brush to be held.

Some implementations can be formed from various suitable materials including, but not limited to: plastic composites, PRT or PETE durable thermoplastics, HDPE, PVC, PP, LDPE, carbon fiber, metal, metal alloy, aluminum, brass, fiberglass, resin epoxy, or any suitable material capable of providing necessary structural strength and chemical resistance.

It will be appreciated that the bottom hinged moveable door design described above is one implementation and is presented for purposes of illustrating the principals of the invention. Other hinge arrangements could be used such as left or right side hinged door, a bi-fold type opening arrangement, a sliding mechanism (e.g., in which the door slides up and down), a pop-off (or removable) door, no hinge type, or no door at all.

Some implementations can include one or more door closure magnets disposed on the door, and one or more corresponding metal piece or complementary magnet disposed on the body portion of the case, or vice versa. Some implementations can also include a paintbrush holder magnet disposed on an inside of the space formed by the body portion and the door. The paintbrush holder magnet can attract the metal ferrule of a paintbrush toward the paintbrush holder magnet and help hold the paintbrush in place while inside the holster, even when the holster door is open. Other structures could be used to hold the paintbrush in place inside the holster such as a clip having an interference or tension fit with the paintbrush or paintbrush handle, hook-and-loop fasteners, a hook or other catch to engage the paintbrush, a spring type latch, etc.

Some implementations can include a pocket or recess area on a lower portion of the holster. The pocket can help permit a paintbrush to be inserted or removed easily and can also permit a user to place a liner (or sleeve) formed from a thin, flexible material into the paintbrush holster. The liner can be changeable and/or washable and may be resistant to paint or other chemicals (e.g., lacquer, varnish, stain, oil, epoxy, etc.). The liner can help prevent the holster from becoming soiled with paint or other liquids and/or from being damaged by the liquids on the paintbrush. The liner could be formed from one or more of the materials mentioned above for forming the holster itself.

Some implementations can include a rectangular spring clip as shown in the figures discussed above. The clip can be used to removably attach the holster to pants or belt. The clip can be rotated to permit the holster to be rotated to a desirable position when in use. A spring-loaded clip is shown for illustration purposes. However, the clip could include a spring metal clip, a bent hook, a clamp, a magnet, one or more straps, a hook-and-loop fastener, etc.

It is, therefore, apparent that there is provided, in accordance with the various embodiments disclosed herein, a paint brush holster and liner.

While the disclosed subject matter has been described in conjunction with a number of embodiments, it is evident that many alternatives, modifications and variations would be, or are, apparent to those of ordinary skill in the applicable arts. Accordingly, Applicant intends to embrace all such alternatives, modifications, equivalents and variations that are within the spirit and scope of the disclosed subject matter.

What is claimed is:

1. A paintbrush holster comprising:

a body having a first side, a second side, a bottom, and a back side having an upper section, a lower section, and a transition between the upper section and the lower section, the transition having an angle extending toward an outside from the upper section to the lower section, wherein the body has a recessed body area configured to permit a handle of a paintbrush to pass through the recessed body area, and wherein the body has angled corners;

a door connected to the body via one or more hinges, the door having a recessed door area configured to permit the handle of the paintbrush to pass through the recessed door area;

a single finger catch for releasing and opening the door, wherein the single finger catch is disposed at an upper edge of the door and is located centrally on the door opposite the one or more hinges; and a clip for removably attaching the paintbrush holster to a user wearable, wherein the clip is rotatable and, when rotated, causes the paintbrush holster to rotate corresponding to the clip.

2. The paintbrush holster of claim 1, wherein the body includes one or more body closure magnets attached to a back surface of the paintbrush holster adjacent to the recessed body area.

3. The paintbrush holster of claim 2, wherein the door includes one or more magnets or metal elements attached to an inside of the door adjacent the recessed body area, which corresponds to locations of the one or more body closure magnets.

4. The paintbrush holster of claim 1, further comprising a paintbrush holder magnet disposed inside a back surface of the paintbrush holster.

5. The paintbrush holster of claim 1, further comprising a removable liner configured to be inserted into the paintbrush holster.

6. The paintbrush holster of claim 1, wherein the clip includes one or more of a spring metal clip, a bent hook, a clamp, a magnet, one or more straps, or a hook-and-loop fastener.

7. A paintbrush holster comprising:

a body having a first side, a second side, a bottom, and a back side having an upper section, a lower section, and a transition between the upper section and the lower section, the transition having an angle extending toward an outside from the upper section to the lower section, wherein the body has a recessed body area configured to permit a handle of a paintbrush to pass through the recessed body area, wherein the body has angled corners;

a door connected to the body via one or more hinges, the door having a recessed door area configured to permit the handle of the paintbrush to pass through the recessed door area; and a single finger catch for releasing and opening the door, wherein the single finger catch is disposed at an upper edge of the door and is located centrally on the door opposite the one or more hinges;

a paintbrush holder mechanism, wherein the paintbrush holder mechanism holds the paintbrush in place inside the paintbrush holster when the door is in open and closed positions.

8. The paintbrush holster of claim 7, wherein the paintbrush holder mechanism includes one or more of a hook, a catch, a magnet, a clip, an interference fit clip, a tension fit clip, hook-and-loop fasteners, or a spring type latch.

9. The paintbrush holster of claim 7, wherein the body includes one or more body closure magnets attached to a back side of the paintbrush holster adjacent to the recessed body area.

10. The paintbrush holster of claim 9, wherein the door includes one or more magnets or metal elements attached to an inside of the door adjacent the recessed body area, which corresponds to locations of the one or more body closure magnets.

11. The paintbrush holster of claim 7, further comprising a liner and a recess area in the lower section of the paintbrush holster, wherein the recess area is formed to accommodate the liner.

12. The paintbrush holster of claim 11, wherein the liner is formed from one or more of a thin or a flexible material.

13. The paintbrush holster of claim 11, wherein the liner is formed from one or more of a changeable, a washable, or a disposable material.

14. The paintbrush holster of claim 11, wherein the liner is resistant to one or more of paint or chemicals.

15. The paintbrush holster of claim 11, wherein the liner is formed from one or more of plastic composites, PRT durable thermoplastics, PETE durable thermoplastics, HDPE, PVC, PP, LDPE, carbon fiber, metal, metal alloy, fiberglass, or resin epoxy materials.

16. The paintbrush holster of claim 7, wherein the paintbrush holster is formed from one or more of plastic composites, PRT durable thermoplastics, PETE durable thermoplastics, HDPE, PVC, PP, LDPE, carbon fiber, metal, metal alloy, fiberglass, or resin epoxy materials.

* * * * *